US007174814B2

(12) United States Patent
Liao

(10) Patent No.: US 7,174,814 B2
(45) Date of Patent: Feb. 13, 2007

(54) TOOL HANDLE HAVING TOOL RECEIVING STRUCTURE

(76) Inventor: Youn Chyuan Liao, No. 68-1, Fusin North Road, Situn, Taichung 40741 (TW)

( * ) Notice: Subject to any disclaimer, the term of this patent is extended or adjusted under 35 U.S.C. 154(b) by 11 days.

(21) Appl. No.: 11/124,884

(22) Filed: May 9, 2005

(65) Prior Publication Data

US 2005/0284267 A1 Dec. 29, 2005

(30) Foreign Application Priority Data

Jun. 25, 2004 (TW) ..... 93118550 A

(51) Int. Cl.
*B25G 1/08* (2006.01)

(52) U.S. Cl. ..... 81/177.4; 81/490

(58) Field of Classification Search ..... 81/177.4, 81/439, 490

See application file for complete search history.

(56) References Cited

U.S. PATENT DOCUMENTS

| | | | | |
|---|---|---|---|---|
| 5,967,003 | A | 10/1999 | Lin | 81/58.3 |
| 6,032,332 | A * | 3/2000 | Lin | 16/111.1 |
| 6,164,172 | A | 12/2000 | Huang | 81/490 |
| 6,742,421 | B1 * | 6/2004 | Chen | 81/490 |

* cited by examiner

*Primary Examiner*—David B. Thomas
(74) *Attorney, Agent, or Firm*—Charles E. Baxley

(57) ABSTRACT

A tool handle includes a handle member having a number of compartments formed in an outer peripheral portion, a number of holders rotatably received in the compartments of the handle member and each having an engaging hole for receiving a tool member, and a rotary member rotatably attached to the handle member. The holders each includes an extension. The rotary member includes an actuator or a peripheral groove for selectively engaging with the extensions of the holders, and for selectively rotating the holders relative to the handle member to an outwardly opening and working position, by rotating the rotary member relative to the handle member.

8 Claims, 7 Drawing Sheets

TOOL HANDLE HAVING TOOL RECEIVING STRUCTURE

BACKGROUND OF THE INVENTION

1. Field of the Invention

The present invention relates to a tool handle, and more particularly to a tool handle having a tool receiving structure for suitably receiving tool members therein, and for allowing the tool members to be easily fetched or grasped by the users.

2. Description of the Prior Art

Typical tool devices comprise a handle including a driving shank extended therefrom, for rotating and for operating the driving shank to rotate or to drive fasteners, or other tool members. The handles of some of the tool devices may comprise one or more compartments formed therein for receiving or storing various tool members therein.

Normally, the typical tool devices may comprise a cover detachably or openably attached thereto, to selectively enclose the compartments thereof, and to selectively enclosing and shielding the tool members within the compartments of the handles of the tool devices. The tool members may be fetched or obtained when the cover is opened or disengaged from the handle.

For example, U.S. Pat. No. 5,967,003 to Lin, and U.S. Pat. No. 6,164,172 to Huang disclose two of the typical tool devices each also comprising one or more covers detachably or openably attached to the handle, to selectively enclosing and shielding the tool members within the compartments of the handles of the tool devices.

However, when the cover is opened or disengaged from the handle, not only the tool members required to be fetched but also the other tool members may all be exposed, such that all of the tool members may have a good chance to be disengaged from the handle inadvertently. In addition, the cover should be disengaged and separated from the handle, and may thus have a good chance to be lost or disappeared inadvertently.

U.S. Pat. No. 6,032,332 to Lin disclose another typical tool device comprising a chamber formed in the handle for rotatably receiving a rod, onto which a number of tool members are attached, and a transparent lid pivotally attached to the handle, for aligning with either of the tool members of the rod, and for selectively tilting the tool members to be fetched, and thus for allowing the tool members to be easily fetched by the users.

However, the transparent lid includes a tiny width or area that may not be easily depressed by the users, particularly when against the spring members, such that the typical tool device may not be easily operated by the users, and the hands of the users may feel hurt after depressing the transparent lid several times.

The present invention has arisen to mitigate and/or obviate the afore-described disadvantages of the conventional tool handles.

SUMMARY OF THE INVENTION

The primary objective of the present invention is to provide a tool handle including a tool receiving structure for suitably receiving tool members therein, and for allowing the tool members to be easily fetched or grasped by the users.

In accordance with one aspect of the invention, there is provided a tool handle comprising a handle member including a number of compartments formed in an outer peripheral portion thereof, a number of holders rotatably received in the compartments of the handle member respectively, and each including an engaging hole formed therein for receiving a tool member therein, and a rotary member rotatably attached to the handle member, and including an opening device for opening the holders relative to the handle member respectively by rotating the rotary member relative to the handle member.

The holders each includes an extension extended therefrom, the opening device includes an actuator extended from the rotary member, for selectively engaging with the extensions of the holders respectively, and for selectively rotating or opening the holders relative to the handle member to an outwardly opening and working position.

The rotary member includes a peripheral groove formed therein, and facing toward the holders, for slidably receiving the extensions of the holders respectively, and for retaining the holders relative to the handle member at an inwardly closing and storing position respectively.

The rotary member includes a spring-biased projection engaged therein, for anchoring and positioning the rotary member to the handle member at selected positions. The handle member includes a cover secured thereto, and having a number of depressions formed therein, for engaging with the spring-biased projection of the rotary member respectively.

The cover includes a shaft extended therefrom, and rotatably engaged through the rotary member, to rotatably attach the rotary member to the handle member. The cover preferably includes a peripheral wall extended therefrom, and having the depressions formed therein.

The holders each includes a notch formed therein and communicating with the engaging hole thereof, for partially exposing the tool member, and for allowing the tool member to be easily fetched by users.

The handle member includes at least one cavity formed therein and communicating with each of the compartments thereof, and the holders each includes an axle extended therefrom and engaged into the cavities of the handle member, to rotatably secure the holders to the handle member respectively.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
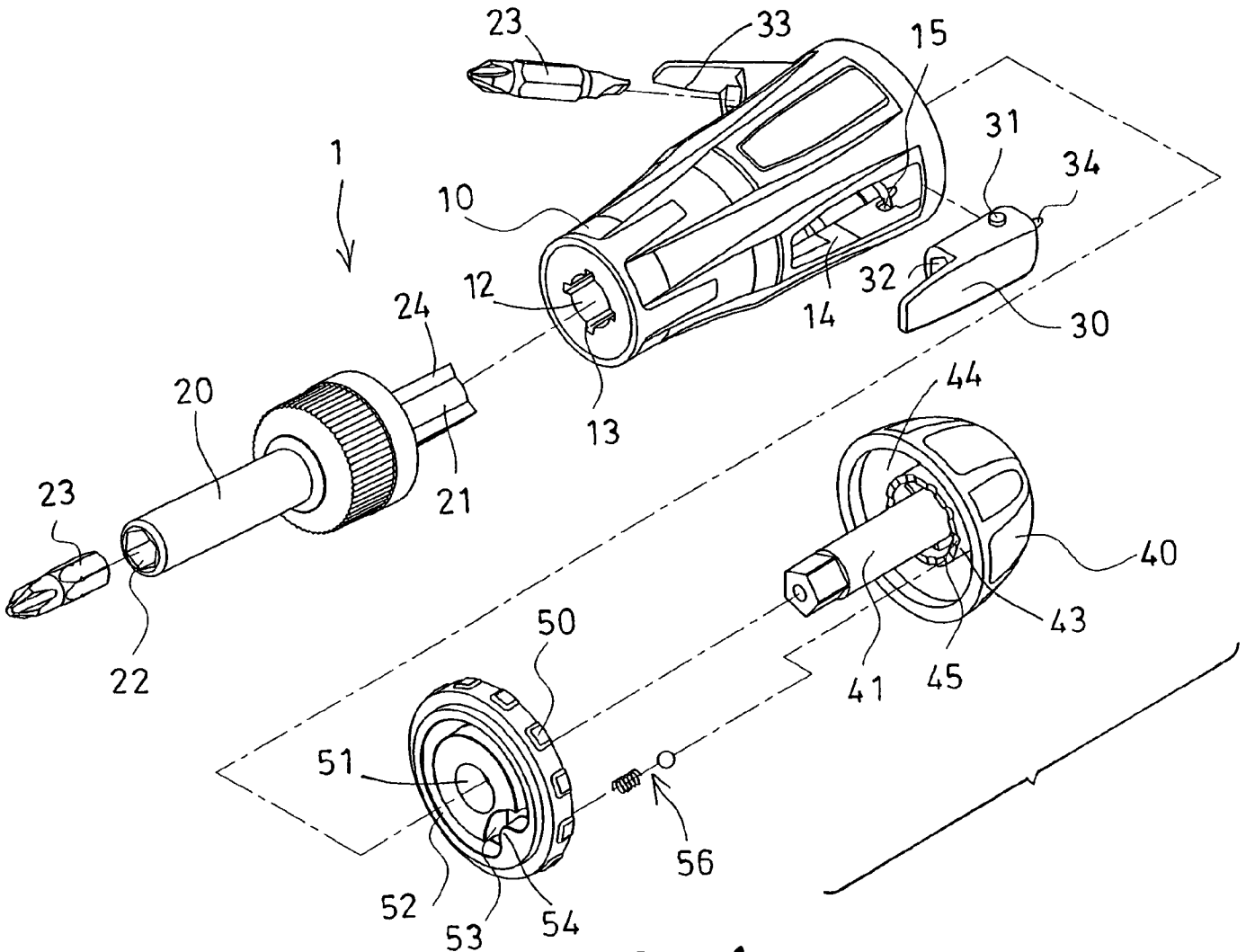
FIG. 1 is a partial exploded view of a tool handle in accordance with the present invention.
Figure 3:
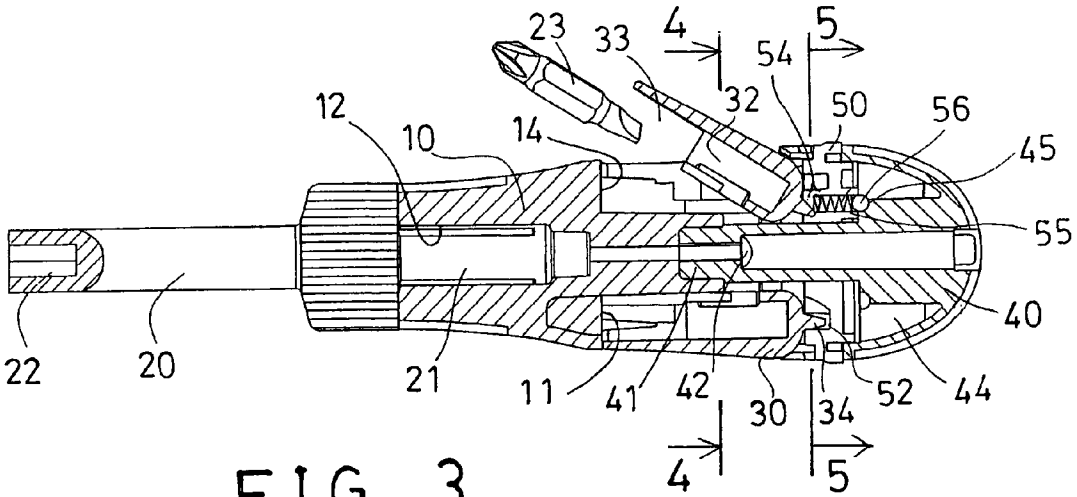
FIG. 3 is a partial cross sectional view of the tool handle, taken along lines 3—3 of FIG. 2, illustrating the operation of the tool handle.
Figure 2:
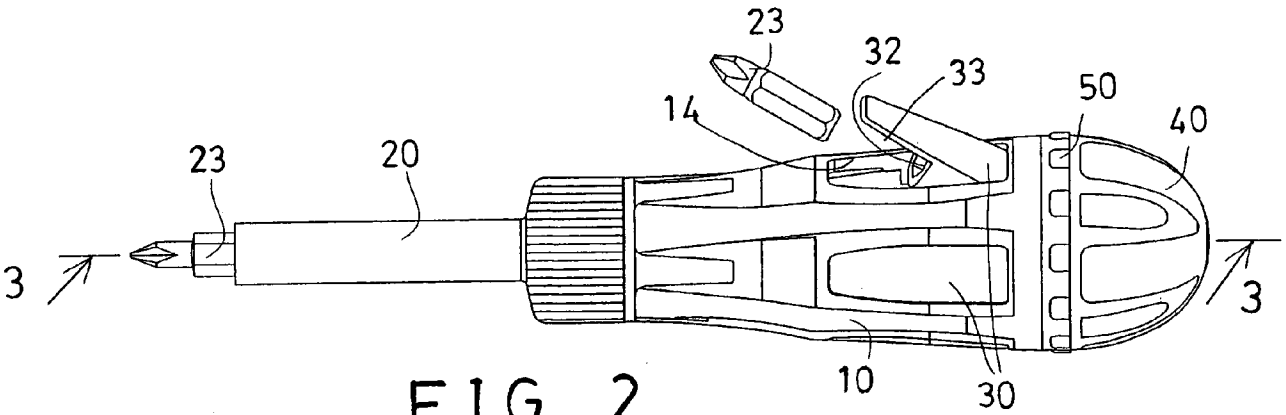
FIG. 2 is another partial exploded view of the tool handle.
Figure 5:
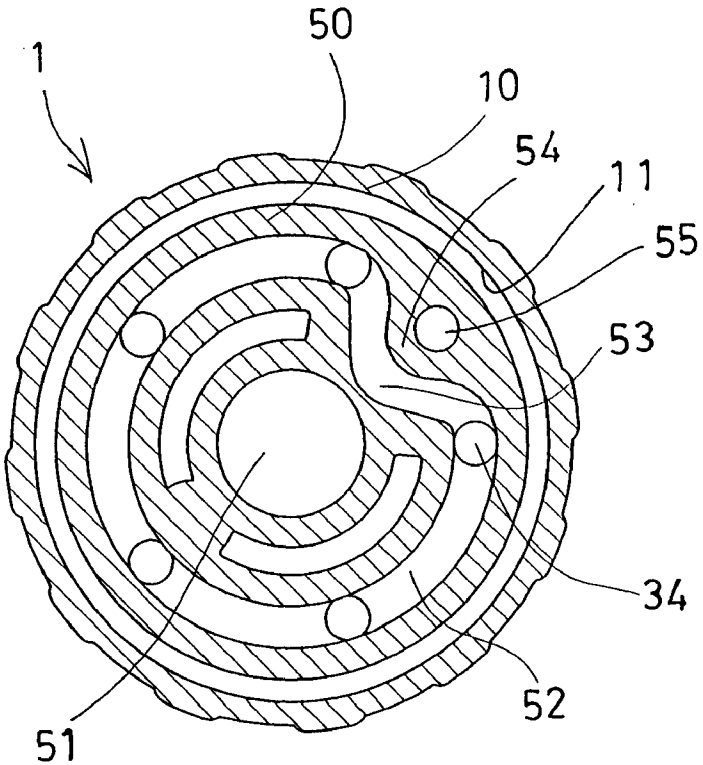
FIG. 5 is a partial cross sectional view taken along lines 5—5 of FIG. 3.
Figure 4:
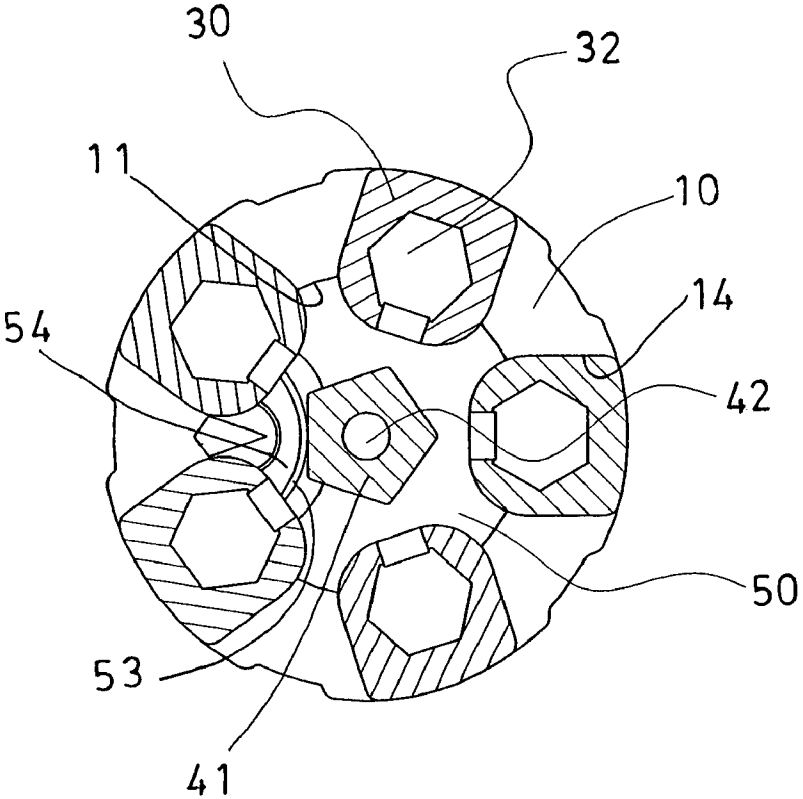
FIG. 4 is a partial cross sectional view taken along lines 4—4 of FIG. 3.

Referring to the drawings, and initially to FIGS. 1–5, a tool handle 1 in accordance with the present invention comprises a handle body or handle member 10 including a chamber 11 formed therein (FIGS. 3, 5), and including a bore 12 formed in one end, such as formed in the front end thereof (FIGS. 1, 3), for receiving and anchoring or securing one end or rear end 21 of a driving stem 20 which includes an engaging hole 22 formed in the other end thereof for receiving tool members 23 therein.

Figure 6:
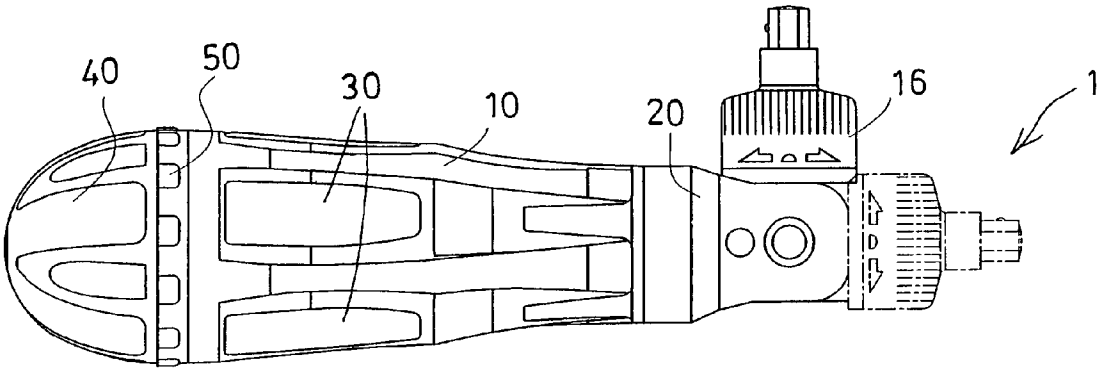
FIG. 6 is a plan view illustrating an application of the tool handle.
Figure 7:
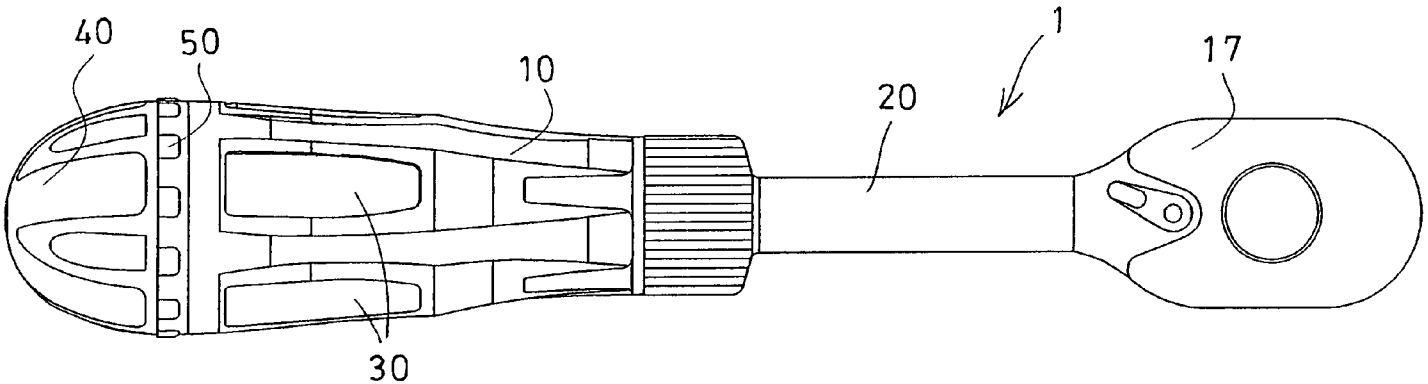
FIG. 7 is another plan view similar to FIG. 6, illustrating another application of the tool handle.

The rear end 21 of the driving stem 20 may be detachably attached or anchored or secured to the handle body or handle member 10 with such as latches (not shown), ribs or nibs 24, or the like, which may be engaged into the corresponding slots or grooves 13 of the handle member 10, to solidly secure or anchor the driving stem 20 to the handle member 10, and to prevent the driving stem 20 from being rotated relative to the handle member 10. The attachment or the engagement of the driving stem 20 to the handle member 10 is typical and will not be described in further details. The driving stem 20 may include a rotatable driving head 16 attached thereto (FIG. 6), or a ratchet driving mechanism 17 attached thereto (FIG. 7).

Figure 8:
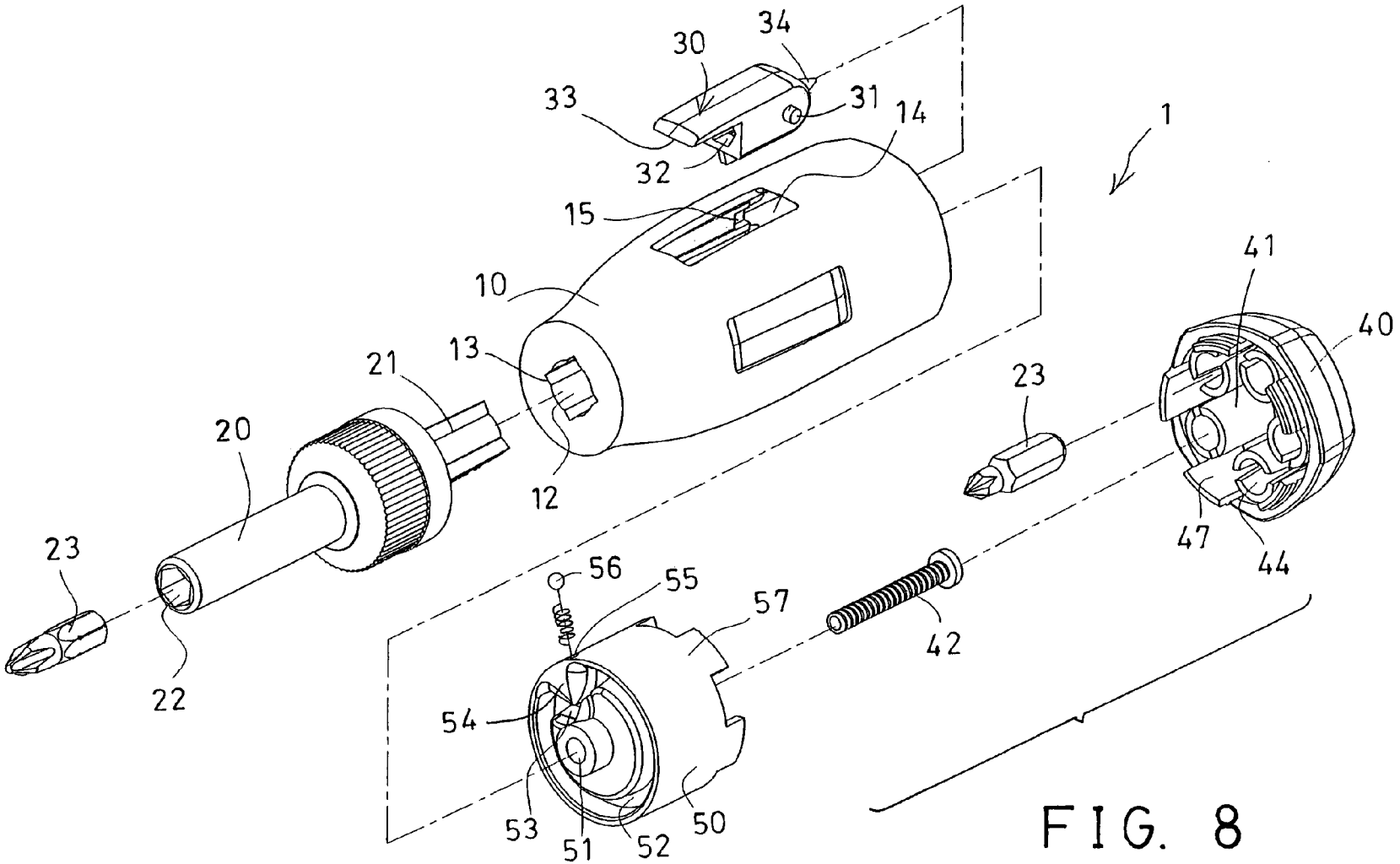
FIG. 8 is a further partial exploded view illustrating the other arrangement of the tool handle.
Figure 9:
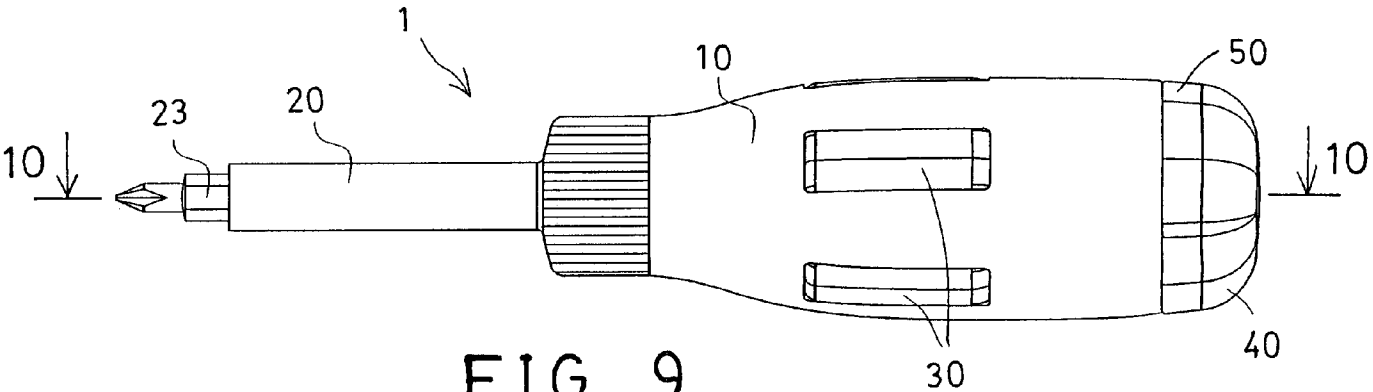
FIG. 9 is a plan view of the tool handle as shown in FIG. 8.

The handle body or handle member 10 includes one or more compartments 14 formed therein, such as formed in the outer peripheral portion thereof, and opened outwardly, and one or more cavities 15 formed therein and communicating with each of the compartments 14 thereof (FIGS. 1, 8). One or more casings or holders 30 are received in the compartments 14 of the handle member 10 respectively, and each includes an axle 31 extended therefrom and engaged into the cavities 15 of the handle member 10, for rotatably or pivotally securing the holders 30 to the handle member 10 respectively.

Figure 10:
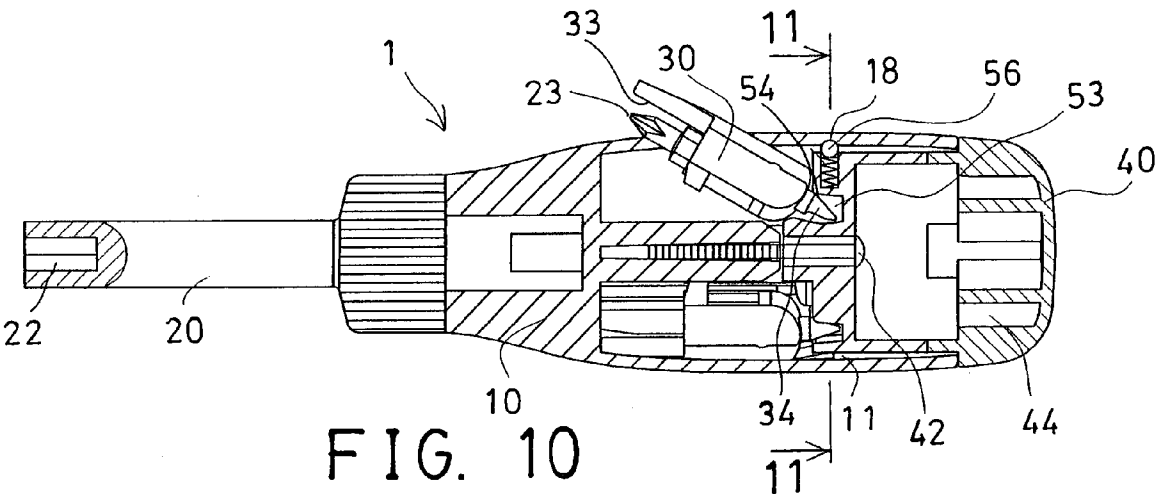
FIG. 10 is a partial cross sectional view taken along lines 10—10 of FIG. 9.
Figure 11:
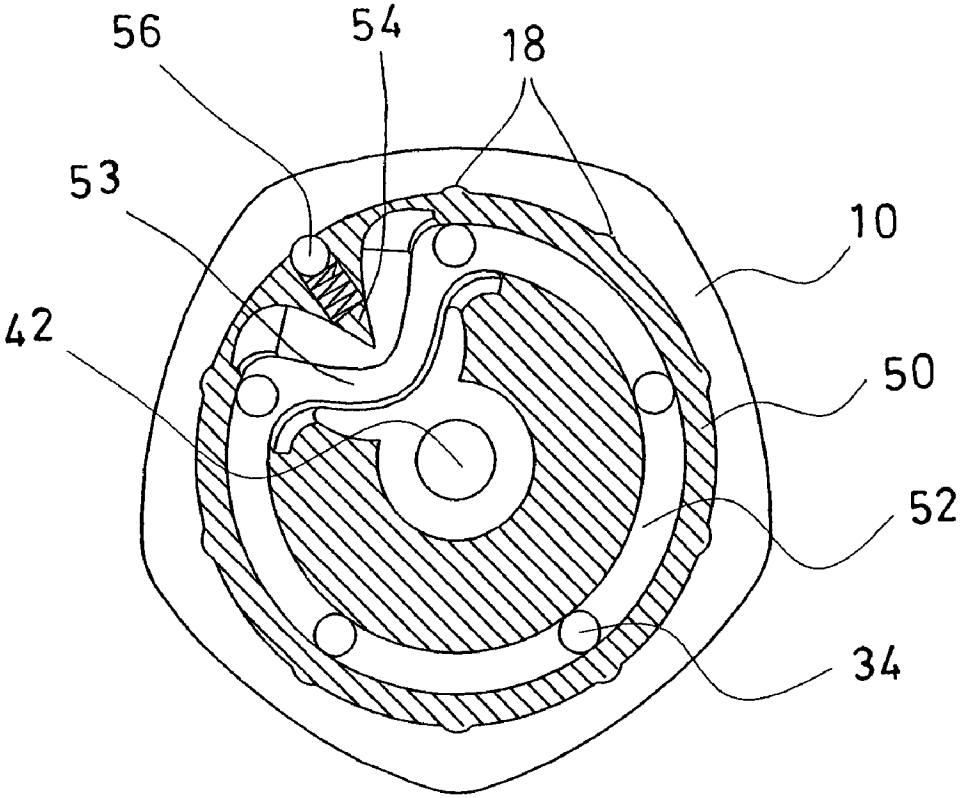
FIG. 11 is a partial cross sectional view taken along lines 11—11 of FIG. 10.

The holders 30 each includes an engaging hole 32 formed therein for receiving or storing the tool members 23 therein, and each includes a notch 33 formed therein and communicating with the engaging hole 32 thereof, for partially exposing the tool members 23, and for allowing the tool members 23 to be easily fetched or grasped or obtained by the users. The holders 30 are rotatable relative to the handle member 10 between an outwardly opening or working position and an inwardly closing or storing position respectively. The holders 30 each further includes an extension 34 extended rearwardly therefrom, best shown in FIGS. 1, 3, and 10.

A cover 40 includes a shaft 41 extended therefrom and engaged into the handle member 10, for securing to the handle member 10 with one or more fasteners 42, and includes a sleeve or peripheral wall 43 extended therein to form or define one or more spaces 44 therein (FIGS. 1 and 3), and for receiving or storing the tool members 23 therein, and includes a number of depressions 45 (FIGS. 1, 3) formed in the outer or free edge of the peripheral wall 43, for positioning purposes.

A rotary member 50 includes a bore 51 formed therein for receiving the shaft 41, and for rotatably attaching or securing to the handle member 10. It is preferable that the actuator or rotary member 50 is rotatably retained or positioned between the handle member 10 and the cover 40, and includes a peripheral recess or groove 52 formed therein, and facing toward the holders 30, for slidably receiving the extensions 34 of the holders 30 respectively (FIGS. 3, 5), and/or for retaining the holders 30 relative to the handle member 10 at the inwardly closing or storing position respectively.

The rotary member 50 further includes a curved portion 53 and/or an actuator 54 formed therein (FIG. 1), and communicating with the peripheral recess or groove 52 thereof or extended and curved into the peripheral recess or groove 52 thereof, for selectively engaging with the extensions 34 of the holders 30 respectively, and for selectively actuating or rotating the holders 30 relative to the handle member 10 to the outwardly opening or working position respectively, and thus to allow the tool members 23 to be easily fetched or grasped by the users.

The rotary member 50 further includes an aperture 55 formed therein (FIGS. 3, 5), for receiving and engaging a spring-biased projection 56 therein, which may be engaged with either of the depressions 45 of the peripheral wall 43 of the cover 40 (FIG. 3), for anchoring or positioning the rotary member 50 to the cover 40 and thus to the handle member 10 at selected positions, or for maintaining the engagement of the curved portion 53 or the actuator 54 of the rotary member 50 with either of the extensions 34 of the holders 30 respectively.

In operation, the holders 30 may be selectively rotated and opened relative to the handle member 10 to the outwardly opening or working position by rotating the rotary member 50 relative to the handle member 10 and by engaging the curved portion 53 or the actuator 54 of the rotary member 50 with either of the extensions 34 of the holders 30 respectively, to allow the tool members 23 to be easily fetched or grasped by the users, or to suitably receive and retain the tool members 23 within the compartments 14 of the handle member 10 respectively. The prior tool handles fail to provide a rotary member 50 rotatably attached to the handle member 10, to selectively actuate and open the selected holders 30 relative to the handle member 10. The curved portion 53 or the actuator 54 of the rotary member 50 may thus be formed as an actuating or opening means or device for rotating or opening the holders 30 relative to the handle member 10 respectively, to selectively open the holders 30 relative to the handle member 10.

Alternatively, as shown in FIGS. 8–11, the aperture 55 of the rotary member 50 may be faced radially and outwardly for receiving the spring-biased projection 56 therein, which may be engaged with either of the depressions 18 that are formed in the handle member 10 (FIGS. 10, 11), for directly anchoring or positioning the rotary member 50 to the handle member 10 at selected positions, or for maintaining the engagement of the curved portion 53 or the actuator 54 of the rotary member 50 with either of the extensions 34 of the holders 30 respectively.

The rotary member 50 may include one or more juts 57 extended therefrom, for engaging with the corresponding juts 47 of the cover 40, for anchoring or securing the cover 40 to the rotary member 50, and for allowing the cover 40 and the rotary member 50 to be rotated in concert with each other, and relative to the handle member 10. The cover 40 and the rotary member 50 may be rotatably secured to the handle member 10 with the fastener 42 (FIG. 10), for example.

Accordingly, the tool handle in accordance with the present invention includes a tool receiving structure for suitably receiving tool members therein, and for allowing the tool members to be easily fetched or grasped by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool handle comprising:

a handle member including a plurality of compartments formed in an outer peripheral portion thereof, a plurality of holders rotatably received in said compartments of said handle member respectively, and each including an engaging hole formed therein for receiving a tool member therein, and each including an extension extended therefrom, and a rotary member rotatably attached to said handle member, and including means for opening said holders relative to said handle member respectively by rotating said rotary member relative to said handle member, said opening means including an actuator extended from said rotary member, for selectively engaging with said extensions of said holders respectively, and for selectively rotating said holders relative to said handle member to an outwardly opening and working position.

2. The tool handle as claimed in claim 1, wherein said rotary member includes a peripheral groove formed therein, and facing toward said holders, for slidably receiving said extensions of said holders respectively, and for retaining said holders relative to said handle member at an inwardly closing and storing position respectively.

3. The tool handle as claimed in claim 1, wherein said holders each includes a notch formed therein and communicating with said engaging hole thereof, for partially exposing the tool member, and for allowing the tool member to be easily fetched by users.

4. The tool handle as claimed in claim 1, wherein said handle member includes at least one cavity formed therein and communicating with each of said compartments thereof, and said holders each includes an axle extended therefrom and engaged into said cavities of said handle member, to rotatably secure said holders to said handle member respectively.

5. A tool handle comprising:

a handle member including a plurality of compartments formed in an outer peripheral portion thereof, a plurality of holders rotatably received in said compartments of said handle member respectively, and each including an engaging hole formed therein for receiving a tool member therein, and a rotary member rotatably attached to said handle member, and including means for opening said holders relative to said handle member respectively by rotating said rotary member relative to said handle member, and said rotary member including a spring-biased projection engaged therein, for anchoring and positioning said rotary member to said handle member at selected positions.

6. The tool handle as claimed in claim 5, wherein said handle member includes a cover secured thereto, and having a plurality of depressions formed therein, for engaging with said spring-biased projection of said rotary member respectively.

7. The tool handle as claimed in claim 6, wherein said cover includes a shaft extended therefrom, and rotatably engaged through said rotary member, to rotatably attach said rotary member to said handle member.

8. The tool handle as claimed in claim 6, wherein said cover includes a peripheral wall extended therefrom, and having said depressions formed therein.

* * * * *